US010429115B2

(12) United States Patent
Shen et al.

(10) Patent No.: US 10,429,115 B2
(45) Date of Patent: Oct. 1, 2019

(54) REFRIGERATOR

(71) Applicant: BSH HAUSGERAETE GMBH, Munich (DE)

(72) Inventors: Yongyan Shen, Chuzhou (CN); Xianzhong Wang, Nanjing (CN); Ruoquan Xu, Su Zhou (CN); Yong Zhang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 274 days.

(21) Appl. No.: 15/373,009

(22) Filed: Dec. 8, 2016

(65) Prior Publication Data

US 2017/0176081 A1 Jun. 22, 2017

(30) Foreign Application Priority Data

Dec. 16, 2015 (CN) ..... 2015 2 1047397 U

(51) Int. Cl.

| | |
|---|---|
| ***F25C 5/182*** | (2018.01) |
| ***F25C 5/04*** | (2006.01) |
| ***F25C 5/20*** | (2018.01) |

(52) U.S. Cl.

CPC ..... *F25C 5/182* (2013.01); *F25C 5/046* (2013.01); *F25C 5/22* (2018.01); *F25C 2400/10* (2013.01)

(58) Field of Classification Search

CPC ..... F25C 5/22; F25C 5/182; F25C 5/046

See application file for complete search history.

(56) References Cited

U.S. PATENT DOCUMENTS

2011/0146324 A1* 6/2011 Lee ..... F25C 5/185 62/344

* cited by examiner

*Primary Examiner* — Cassey D Bauer

(74) *Attorney, Agent, or Firm* — Laurence A. Greenberg; Werner H. Stemer; Ralph E. Locher

(57) ABSTRACT

A refrigerator has a storage compartment, a door for opening and closing the storage compartment, an ice-making machine and an ice storage compartment. The ice-making machine is used to produce an ice cube. The ice storage compartment is disposed below the ice-making machine, so as to accommodate an ice cube. The ice storage compartment has a discharge port. A movable blocking member and an ice-crushing cutter are located in the ice storage compartment. A distributor is located on the door and used to distribute the ice cube from the ice storage compartment to the outside. The ice storage compartment further includes an opening and closing mechanism for opening or closing the discharge port. Because the discharge port of the ice storage compartment can be closed, the ice-crushing cutter disposed above the discharge port will not be unconsciously touched, and a user is avoided from being hurt by the ice-crushing cutter.

8 Claims, 5 Drawing Sheets

REFRIGERATOR

CROSS-REFERENCE TO RELATED APPLICATION

This application claims the priority, under 35 U.S.C. § 119, of Chinese application CN 2015 210 47397.6, filed Dec. 16, 2015; the prior application is herewith incorporated by reference in its entirety.

BACKGROUND

Field of the Invention

The present invention relates to the field of household appliances, and in particular to a refrigerator having an ice-making apparatus.

In the prior art, a refrigeration appliance having an ice-making apparatus, such as a refrigerator, produces ice by using cold air and stores the produced ice. The ice-making apparatus includes an ice-making machine and a ice storage barrel, where the ice-making machine produces ice, and the ice storage barrel stores ice departed from the ice-making machine. The ice-making machine and the ice storage barrel both may be disposed in a storage compartment or on a door of a storage compartment. For convenience of a user, the door of the storage compartment may further include a distributor for distributing the ice stored in the ice storage barrel; the ice storage barrel is communicated with an ice-discharging channel and the distributor; and the ice-making apparatus outputs produced ice to the distributor through the ice-discharging channel.

SUMMARY OF THE INVENTION

An objective of the present utility model is to resolve a problem that a user is hurt by an ice-crushing cutter when the user accidentally touches the ice-crushing cutter in an ice-making apparatus of a refrigerator.

To achieve the foregoing objective the present invention provides a refrigerator. The refrigerator has a storage compartment and a door for opening and closing the storage compartment. An ice-making machine and an ice storage compartment are located in the storage compartment or on the door, where the ice-making machine is used to produce an ice cube. The ice storage compartment is disposed below the ice-making machine, so as to accommodate the ice cube produced in the ice-making machine. The ice storage compartment has a discharge port, and the ice cube is discharged from the discharge port. A movable blocking member and at least one ice-crushing cutter are located in the ice storage compartment, where the blocking member and the at least one ice-crushing cutter are both disposed above the discharge port. A distributor is located on the door, used to distribute the ice cube from the ice storage compartment to the outside. The ice storage compartment further includes an opening and closing mechanism for opening or closing the discharge port.

Preferably, the opening and closing mechanism is detachably disposed at the ice storage compartment.

Preferably, the opening and closing mechanism is arranged as a cover that can completely block the discharge port.

Preferably, the blocking member is at least partially arranged as the opening and closing mechanism.

Preferably, when the blocking member is at least partially arranged as the opening and closing mechanism, the blocking member has three operation states. In a first state, the blocking member completely opens the discharge port, and the ice storage compartment discharges an ice cube. In a second state the blocking member does not completely open or close the discharge port, and the ice storage compartment discharges crushed ice. In the third state the blocking member completely closes the discharge port, and the ice storage compartment discharges neither an ice cube nor crushed ice.

Preferably, the refrigerator further includes a motor disposed in the storage compartment or on the door, and the blocking member is connected to the motor in an operable manner.

Preferably, the blocking member can be actuated by the motor, so as to be operated in a rotating manner.

Preferably, the blocking member can be actuated by the motor to a predetermined position, so as to eliminate a possibility of touching the ice-crushing cutter through the discharge port.

Preferably, the blocking member can be actuated by the motor to a predetermined position, so as to completely close the discharge port.

Preferably, an entrance of the ice storage compartment is lower than a bottom surface of the ice-making machine, and an ice cube departed from the ice-making machine is first introduced to the entrance of the ice storage compartment.

Compared with the prior art, the present utility model has advantages: When the ice-making apparatus of the refrigerator discharges neither an ice cube nor crushed ice, because the discharge port of the ice storage compartment can be closed, the ice-crushing cutter disposed above the discharge port will not be unconsciously touched, and a user is avoided from being hurt by the ice-crushing cutter when the user accidentally puts a finger into the discharge port of the ice storage compartment and touches the ice-crushing cutter. In addition, when the discharge port of the ice storage compartment is closed and the door of the storage compartment is opened, hot air cannot enter the ice storage compartment through the discharge port, which slows convection between warm and cold air, and avoids hot air from condensing or frosting on an inner surface of the ice storage compartment, thereby reducing power consumption of the refrigerator to a certain extent.

The structure of the present invention and other objectives and beneficial effects of the present invention become more comprehensible through the description of preferable embodiments with reference to the accompanying drawings.

Other features which are considered as characteristic for the invention are set forth in the appended claims.

Although the invention is illustrated and described herein as embodied in a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION

Figure 1:
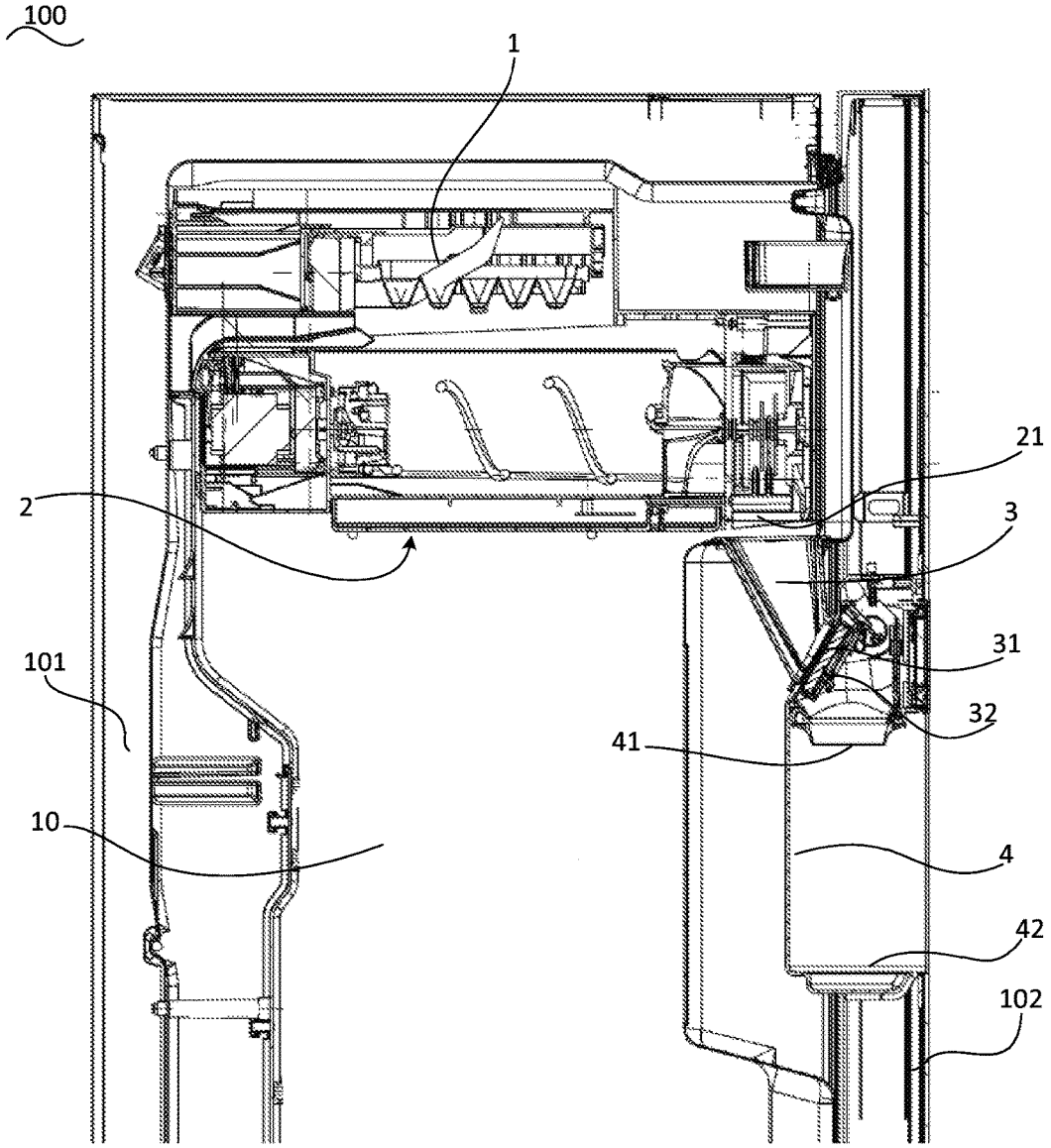
FIG. 1 is a diagrammatic, sectional view of a storage compartment of a refrigerator having an ice-making apparatus according to the invention.
Figure 2:
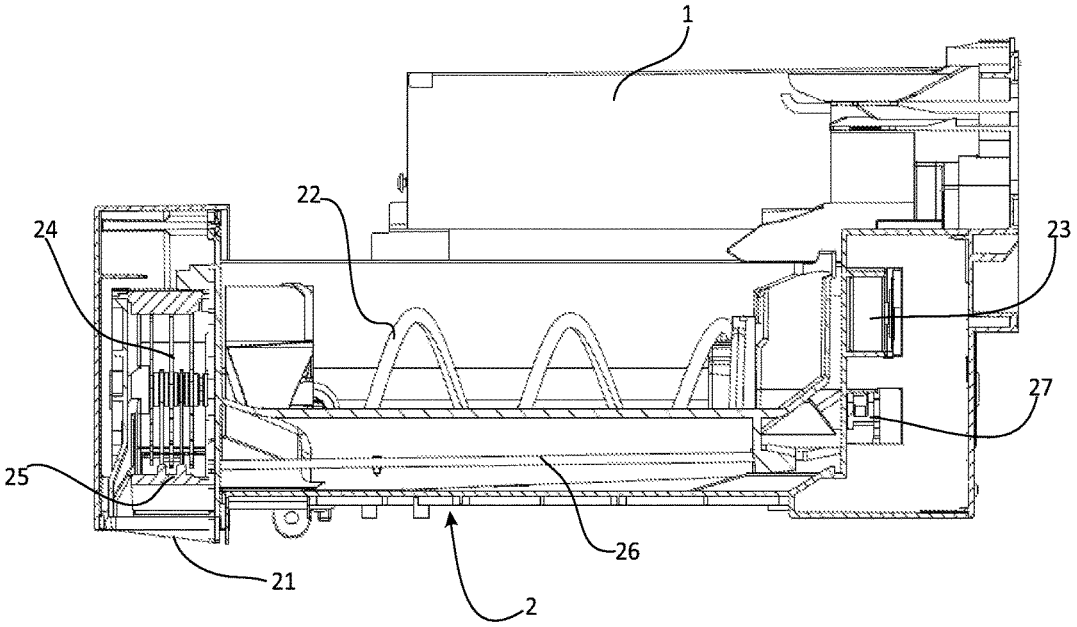
FIG. 2 is a longitudinal sectional view of a part of the ice-making apparatus, where a longitudinal section of a ice-making machine is not shown in FIG. 2, but a longitudinal section of an ice storage compartment is shown in FIG. 2.

Referring now to the figures of the drawings in detail and first, particularly to FIGS. 1 and 2 thereof, there is shown a refrigerator 100, including: a storage compartment 10; a door 102 for opening and closing the storage compartment 10; an ice-making machine 1 and an ice storage compartment 2 located in the storage compartment or on the door, where the ice-making machine 1 is used to produce an ice cube. The ice storage compartment 2 is disposed below the ice-making machine 1, so as to accommodate the ice cube produced in the ice-making machine 1. The ice storage compartment 2 has a discharge port 21, and the ice cube is discharged from the discharge port 21. A movable blocking member 25 and at least one ice-crushing cutter 24 are located in the ice storage compartment 2, where the blocking member and the at least one ice-crushing cutter are both disposed above the discharge port 21. A distributor 4 is located on the door 102, and used to distribute the ice cube from the ice storage compartment 2 to the outside. The ice storage compartment 2 further includes an opening and closing mechanism for opening or closing the discharge port 21.

The following clearly and completely describes the technical solutions in the embodiments of the present utility model with reference to the accompanying drawings in the embodiments of the present utility model. Apparently, the described embodiments are merely some but not all of the embodiments of the present utility model. All other embodiments obtained by persons of ordinary skill in the art based on the embodiments of the present utility model without creative efforts shall fall within the protection scope of the present utility model.

FIG. 1 is a sectional view of a storage compartment of a refrigerator having an ice-making apparatus. As shown in FIG. 1, the storage compartment 10 of the refrigerator 100 includes a case body 101 and a door 102 for closing the case body 101. The ice-making apparatus constituted by an ice-making machine 1 and an ice storage compartment 2 is located on the top inside of the case body 101 and nears a top wall of the case body 101. An ice cube produced by the ice-making machine 1 falls into the ice storage compartment 2 located below the ice-making machine 1. Because an entrance on the top of the ice storage compartment 2 is lower than a bottom surface of the ice-making machine 1, an ice cube departed from the ice-making machine 1 is first introduced to the entrance of the ice storage compartment 2 and finally enters the ice storage compartment 2. The door 102 for sealing the case body 101 is provided with a connecting channel 3, and the connecting channel 3 is obliquely disposed at an angle of about 45 degrees with respect to a horizontal plane. When the door 102 is closed, the connecting channel 3 is located below the ice storage compartment 2; one end of the connecting channel 3 is connected to a discharge port 21 of the ice storage compartment 2, where an ice cube can be output along the connecting channel 3 from the ice storage compartment 2; and the other end of the connecting channel 3, that is, the bottom of the connecting channel 3, is provided with an ice-discharging port 31, where the ice-discharging port 31 is sealed by a baffle plate 32. The baffle plate 32 is disposed on a distributor housing 4 on the door 102, the distributor housing 4 has a distribution port 41, and the distribution port 41 is in communication with the foregoing ice-discharging port 31. A bottom wall 42 of the ice the distributor housing 4 is provided with a support platform on which an ice container is placed, and the ice container is used to accommodate ice that is output from the connecting channel 3 when the baffle plate 32 is opened.

FIG. 2 is a longitudinal sectional view of a part of the ice-making apparatus of the present utility model, where a longitudinal section of the ice-making machine 1 is not shown in FIG. 2, but a longitudinal section of an ice storage compartment is shown in FIG. 2. As shown in FIG. 2, an ice-pushing screw rod 22 is disposed in the ice storage compartment 2, and is in a driving connection with a first motor 23 disposed at a rear end of the ice storage compartment 2. The ice-pushing screw rod 22 is driven by a first motor 23 to rotate within the ice storage compartment 2. An ice cube that detaches from the ice-making machine 1 and falls into the ice storage compartment 2 may be pushed by the ice-pushing screw rod 22 to the front of the ice storage compartment 2 near the discharge port 21. An ice-crushing cutter 24 is disposed above the discharge port 21 in the front of the ice storage compartment 2, and the ice-crushing cutter 24 is driven by the ice-pushing screw rod 22 to rotate, so as to cut the ice cube in a rotating manner. The cut ice cube may be discharged through the discharge port 21. A blocking member 25 basically disposed around the ice-crushing cutter 24 is also disposed above the discharge port 21, and the blocking member 25 is connected to a driving rod 26. The driving rod 26 is driven by a second motor 27 to rotate, and the blocking member 25 may be driven by the driving rod 26 to rotate around the ice-crushing cutter 24. The blocking member 25 located above the discharge port 21 is driven by the second motor 27 to be oriented in at least three different predetermined positions, so that the blocking member 25 has three different operation states: the blocking member 25 completely opens the discharge port 21, and the ice storage compartment 2 can discharge an ice tube; the blocking member 25 does not completely open or close the discharge port 21, and the ice storage compartment 2 can discharge crushed ice; and the blocking member 25 completely closes the discharge port 21, and the ice storage compartment 2 discharges neither an ice cube nor crushed ice. The following separately describes the three different operation states of the blocking member by using FIG. 3, FIG. 4, and FIG. 5.

Figure 3:
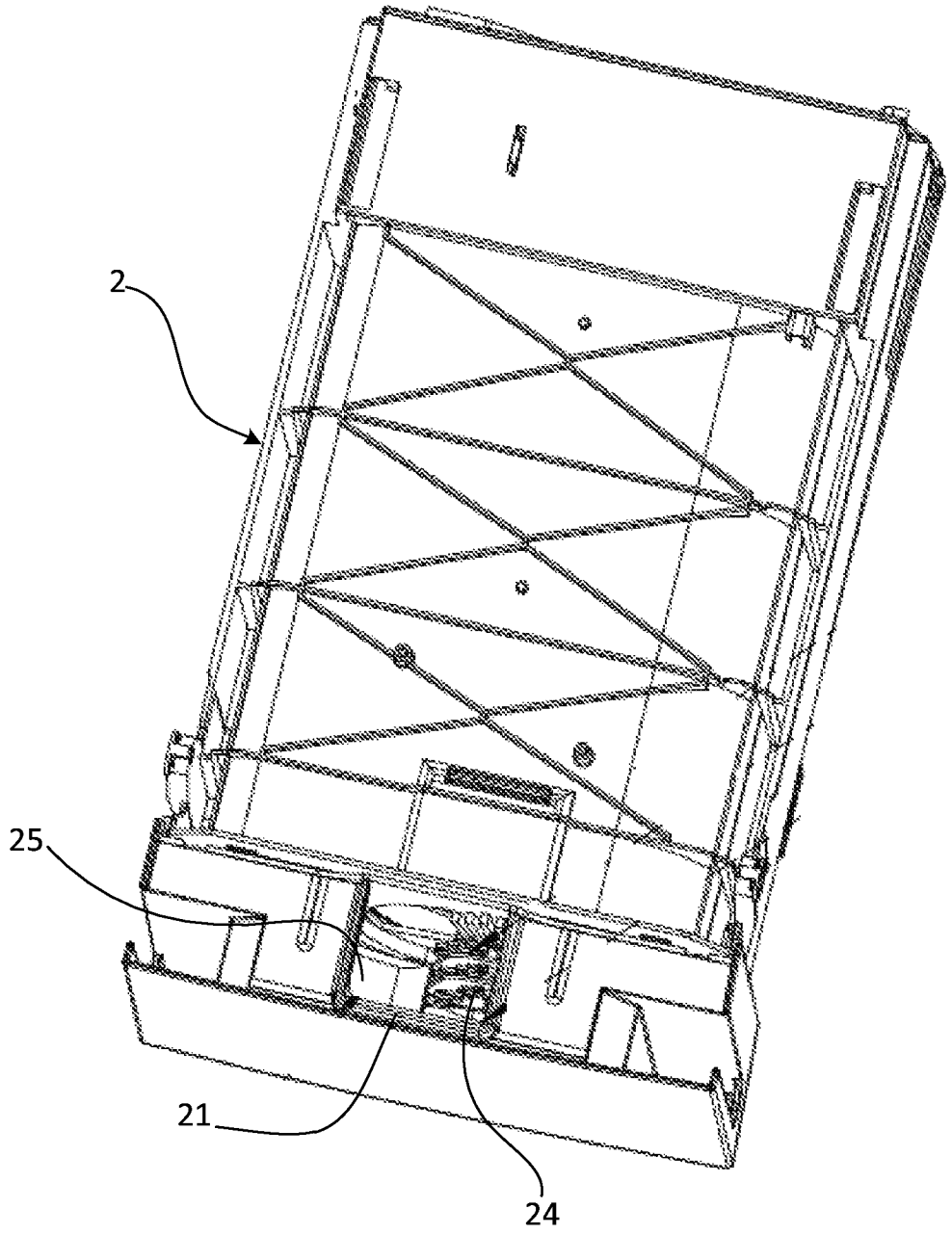
FIG. 3 is a perspective view of a state in which a blocking member in the ice storage compartment completely opens a discharge port.

FIG. 3 is a schematic diagram of a state in which the blocking member in the ice storage compartment completely opens the discharge port. With reference to FIG. 2 and FIG. 3, the blocking member 25 is driven by the second motor 27 to be located in a predetermined rotating position in which the discharge port 21 is completely opened. Ice cubes pushed by the ice-pushing screw rod 22 aggregate in the front of the storage compartment 2 near the discharge port 21, and are cut and stirred by the ice-crushing cutter 24 to be directly discharged from the discharge port 21. Because the blocking member 25 is located in the rotating position in which the discharge port 21 is completely opened, the ice cubes are cut and stirred by the ice-crushing cutter 24 to fall down to the discharge port 21; and because the blocking member 25 does not block the ice cubes from falling down, the ice cubes are directly discharged from the discharge port 21 as complete ice tubes.

Figure 4:
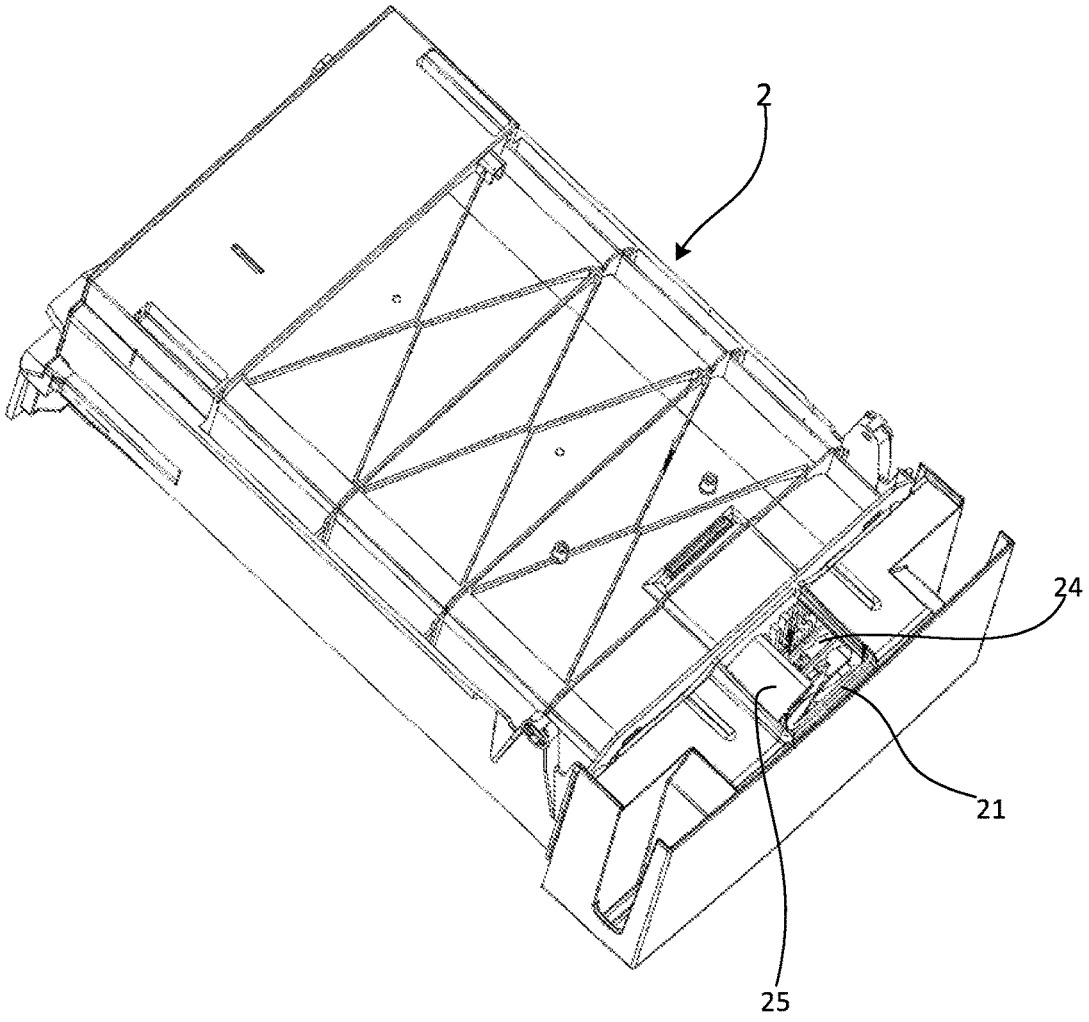
FIG. 4 is a perspective view of a state in which the blocking member in the ice storage compartment half opens or closes the discharge port.

FIG. 4 is a schematic diagram of a state in which the blocking member in the ice storage compartment half opens or closes the discharge port. With reference to FIG. 2 and FIG. 4, the blocking member 25 is driven by the second motor 27 to be located in a predetermined rotating position in which the discharge port 21 is half opened or closed. Ice cubes pushed by the ice-pushing screw rod 22 aggregate in the front of the storage compartment 2 near the discharge port 21, and are cut and stirred by the ice-crushing cutter 24 to tend to fall down towards the discharge port 21. However, because the blocking member 25 blocks the ice cubes from falling down, the ice cubes cannot be discharged from the discharge port 21 as complete ice tubes. Therefore, the ice cubes are blocked by the blocking member 25 and are cut by the continuously rotating ice-crushing cutter 24. Then, the ice cubes are cut into crushed ice, to fall down through the half open discharge port 21 and be discharged.

Figure 5:
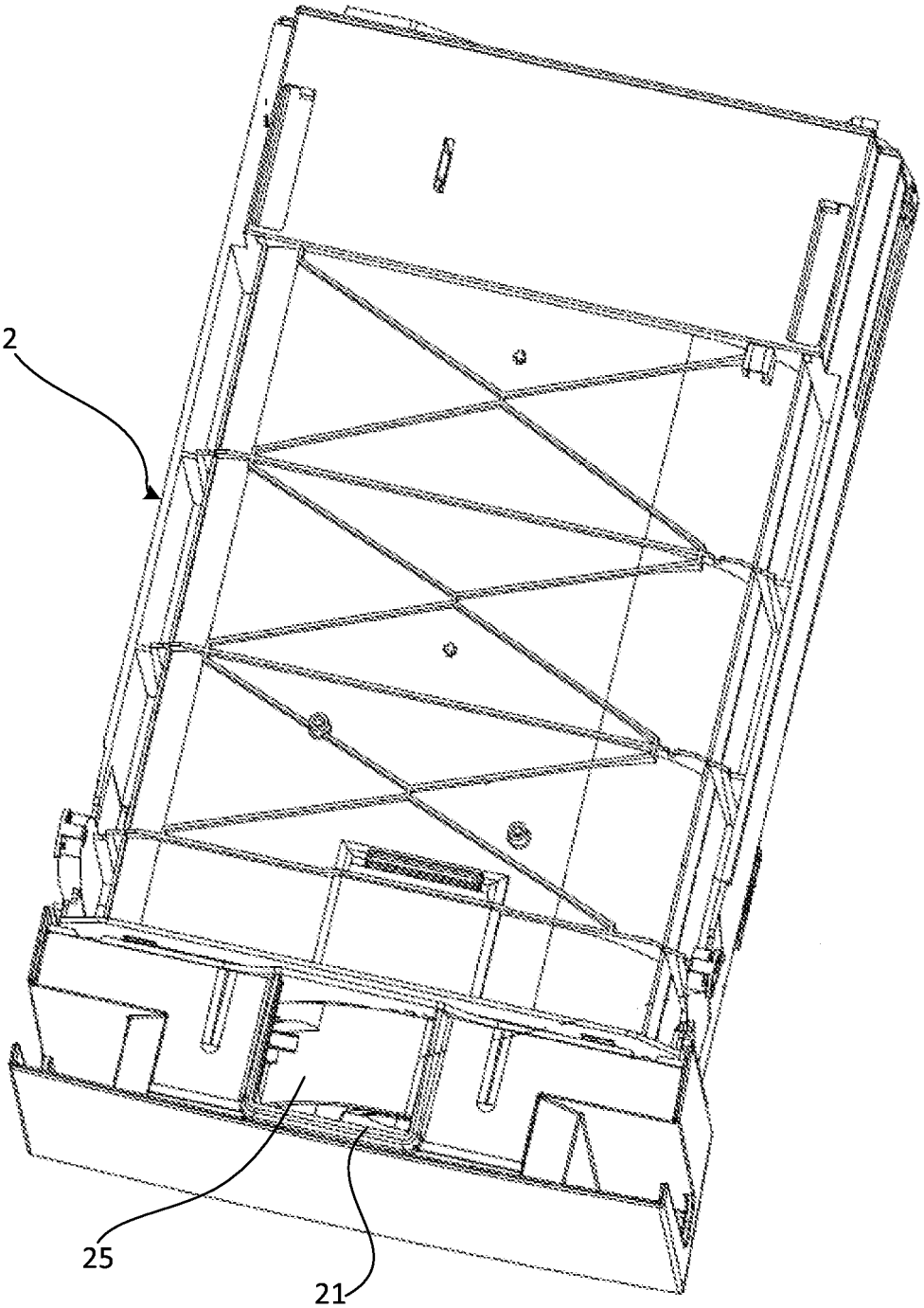
FIG. 5 is a perspective view of a state in which the blocking member in the ice storage compartment completely closes the discharge port.

FIG. 5 is a schematic diagram of a state in which the blocking member in the ice storage compartment completely closes the discharge port. With reference to FIG. 2 and FIG. 5, the blocking member 25 is driven by the second motor 27 to be located in a predetermined rotating position in which the discharge port 21 is completely closed. In this case, the storage compartment 2 does not need to execute an instruction of discharging an ice cube or crushed ice. Because the discharge port 21 of the ice storage compartment 2 can be completely closed, the ice-crushing cutter 24 disposed above the discharge port 21 will not be unconsciously touched, and a user is avoided from being hurt by the ice-crushing cutter 24 when the user accidentally puts a finger into the discharge port 21 of the ice storage compartment and touches the ice-crushing cutter 24. In addition, when the discharge port 21 of the ice storage compartment is closed and the door 102 of the storage compartment is opened, hot air cannot enter the ice storage compartment 2 through the discharge port 21, which slows convection between warm and cold air, and avoids hot air from condensing or frosting on an inner surface of the ice storage compartment 2, thereby reducing power consumption of the refrigerator to a certain extent.

In the foregoing embodiments, the discharge port of the ice storage compartment is completely sealed by using the blocking member. However, in another embodiment, the discharge port may also be sealed by using a detachable opening and closing mechanism. The opening and closing mechanism may be a cover independent from the ice storage compartment, and the cover can exactly and completely seal the discharge port. When the ice-making apparatus needs to be used to discharge ice, the cover may be used to seal the discharge port, which avoids a user from being hurt by the ice-crushing cutter when the user accidentally puts a finger into the discharge port of the ice storage compartment. When the ice-making apparatus does not need to be used to discharge ice, the cover may be then opened, to achieve an ice-discharging function.

Persons skilled in the art can implement or use the present invention according to the foregoing descriptions of the disclosed embodiments. Various modifications to the embodiments are obvious to the persons skilled in the art, and a general principle defined in this specification may be implemented in other embodiments without departing from the spirit and the scope of the present utility model. Therefore, the present utility model is not limited to the embodiments shown in this specification, and should cover a widest scope consistent with the principle and features disclosed in this specification.

Reference numerals: 100 Refrigerator; 101 Case body; 102 Door; 10 Storage compartment; 1 Ice-making machine; 2 Ice storage compartment; 21 Discharge port; 22 Ice-pushing screw rod; 23 First motor; 24 Ice-crushing cutter; 25 Blocking member; 26 Driving rod; 27 Second motor; 3 Connecting channel; 31 Ice-discharging port; 32 Baffle plate; 4 Distributor housing; 41 Distribution port; and 42 Bottom wall.

The invention claimed is:

1. A refrigerator, comprising:

a storage compartment;

a door for opening and closing said storage compartment;

an ice-making machine disposed in said storage compartment and for producing an ice cube;

an ice storage compartment disposed in said storage compartment or on said door, said ice storage compartment is disposed below said ice-making machine, so as to accommodate the ice cube produced in said ice-making machine, said ice storage compartment having a discharge port, and the ice cube is discharged from said discharge port;

a movable blocking member disposed in said ice storage compartment;

at least one ice-crushing cutter disposed in said ice storage compartment, wherein said movable blocking member and said at least one ice-crushing cutter are both disposed above said discharge port;

a distributor disposed on said door and used to distribute the ice cube from said ice storage compartment to an outside; and said ice storage compartment further having an opening and closing mechanism for opening or closing said discharge port, said movable blocking member is at least partially disposed as said opening and closing mechanism and when said movable blocking member is at least partially disposed as said opening and closing mechanism, said movable blocking member has three operational states:

said movable blocking member completely opens said discharge port, and said ice storage compartment discharges the ice cube;

said movable blocking member does not completely open or close said discharge port, and said storage compartment discharges crushed ice; and said movable blocking member completely closes said discharge port blocking access to components of said ice-crushing cutter from beneath said movable blocking member, and said ice storage compartment discharges neither the ice cube nor the crushed ice.

2. The refrigerator according to claim 1, wherein said opening and closing mechanism is detachably disposed at said ice storage compartment.

3. The refrigerator according to claim 2, wherein said opening and closing mechanism is disposed as a cover that completely blocks said discharge port.

4. The refrigerator according to claim 1, further comprising a motor disposed in said storage compartment or on said door, and said movable blocking member is connected to said motor in an operable manner.

5. The refrigerator according to claim 4, wherein said movable blocking member is actuated by said motor, so as to be operated in a rotating manner.

6. The refrigerator according to claim 4, wherein said movable blocking member is actuated by said motor to a predetermined position, so as to eliminate a possibility of touching said ice-crushing cutter through said discharge port.

7. The refrigerator according to claim 4, wherein said movable blocking member is actuated by said motor to a predetermined position, so as to completely close said discharge port.

8. The refrigerator according to claim 1, wherein an entrance of said ice storage compartment is lower than a bottom surface of said ice-making machine, and the ice cube departed from said ice-making machine is first introduced to an entrance of said ice storage compartment.

* * * * *